US006788184B2

(12) United States Patent
Roche

(10) Patent No.: US 6,788,184 B2
(45) Date of Patent: Sep. 7, 2004

(54) HIGH FREQUENCY TRANSFORMER WITH INTEGRATED RECTIFIERS

(76) Inventor: Michel Roche, 12, rue de Saulx-Travannes, F-21000 Dijon (FR)

( * ) Notice: Subject to any disclaimer, the term of this patent is extended or adjusted under 35 U.S.C. 154(b) by 44 days.

(21) Appl. No.: 10/333,445

(22) PCT Filed: Jul. 19, 2001

(86) PCT No.: PCT/FR01/02361

§ 371 (c)(1),
(2), (4) Date: Jan. 21, 2003

(87) PCT Pub. No.: WO02/09128

PCT Pub. Date: Jan. 31, 2002

(65) Prior Publication Data

US 2003/0151484 A1 Aug. 14, 2003

(30) Foreign Application Priority Data

Jul. 21, 2000 (FR) ..... 00 09697

(51) Int. Cl.[7] ..... H01F 27/24

(52) U.S. Cl. ..... 336/212; 336/182; 336/180; 363/97; 29/602.1

(58) Field of Search ..... 336/181–185, 336/212; 363/97, 16; 29/602.1, 606

(56) References Cited

U.S. PATENT DOCUMENTS 4,803,609 A * 2/1989 Gillett et al. ..... 363/17
4,965,712 A * 10/1990 Duspiva et al. ..... 363/126
5,764,500 A * 6/1998 Matos ..... 363/132
5,889,660 A * 3/1999 Taranowski et al. ..... 363/19

FOREIGN PATENT DOCUMENTS

JP 07023562 A * 1/1995 ..... H02M/3/28

* cited by examiner

*Primary Examiner*—Anh Mai
(74) *Attorney, Agent, or Firm*—Allen, Dyer, Doppelt, Milbrath & Gilchrist, P.A.

(57) ABSTRACT

A high frequency transformer may include an integrated rectifier cell with flat windings and/or slotted copper segments stacked on a core branch to provide alternating primary and secondary windings. This reduces inductance leakage and thus increases the operating frequency of the transformer. Rectifying diodes of the rectifier cell may be arranged according to various configurations between the copper segments, and the collection plates may form one of the rectifier outputs. The other output may be provided by connecting all the midpoints of the windings with conductive spacers pressed together along a first axis. The invention is particularly advantageous in static converters, and, more particularly, in spot welding machines, for example.

45 Claims, 2 Drawing Sheets

HIGH FREQUENCY TRANSFORMER WITH INTEGRATED RECTIFIERS

FIELD OF THE INVENTION

The present invention relates to the field of electrical devices, and, more particularly, to transformers for a static converter and transformer-rectifier units.

BACKGROUND OF THE INVENTION

In transformer-rectifier units, transformers are generally used whose primary and secondary windings are coaxial, i.e., superimposed in the radial direction. These windings are made with enameled wire or with copper hoops (i.e., planar winding). Another example is the axial stack system which has been described, for example, in French Patent 1,028,950A to C. Gosselin. This patent discloses the use of copper segments appropriately slotted to form a turn that can be placed around a core for single-phase or tri-phase transformers at 50 or 60 Hz.

U.S. Pat. No. 4,965,712 to Duspiva et al. also discloses turns formed from a cutout copper sheet, but with a core making multiple turns around the copper segment. This transformer is intended for use in a high-frequency circuit.

The two prior art systems described above integrate rectification diodes between the secondary segments. They share the disadvantage of having a high leakage inductance, which may limit the usage frequency and subsequently make the system large, heavy and expensive.

SUMMARY OF THE INVENTION

An object of the invention is to provide a high-frequency transformer which has a relatively simple structure and is relatively inexpensive to manufacture.

In accordance with the invention, a high-frequency transformer may include integrated rectifiers and primary and/or secondary windings including conductive segments surrounding a single branch of the magnetic core, and which preferably operates at a frequency between 3 and 50 kHz. The transformer may further include silicon rectification diodes, which may be implemented in relatively thin chips, directly between the conductive segments (which may be cooper or aluminum, for example). The transformer may also include an alternating stack on the core branch including flat windings and conductive plates alternated several times.

In addition, the rectification may be performed using a two-phase type circuit with two diodes and a secondary winding at a midpoint, a classical bridge, or with a circuit with two filter inductances. Furthermore, the rectification diodes may be securely positioned between the conductive segments forming the secondary windings and collecting segments to assure good thermal and electrical contact.

The collecting segments and the conductive segments may advantageously be cooled by circulating air or by circulating water in the segment using channels, for example. Furthermore, the conductive segments may be used as the primary winding, either directly by placement in series using conductive columns, which may be arranged in quincunx fashion, or the conductive segments may be U-shaped and used as the primary winding. A bridge switching generator may be connected to the conductive segments and include four switches arranged between continuous power supply segments, and the bridge pattern may be repeated several times. The power supply segments may be inserted between the windings or the plates that are used as the secondary winding.

In addition, the conductive segments may be secondary windings, and the rectifier may be formed by connecting the midpoints using conductive columns, along a first axis $\Delta_1$, while the diodes are stacked along a second axis $\Delta_2$. The diodes may also be positioned at the midpoints. Further, the flat windings may be made with enamel wire with two superimposed spirals connected at their center (one being centripetal and the other centrifugal), or by two copper plates cut in spiral fashion and connected together by a weld in the center of the winding, for example. Also, the conductive plate may include a flat thermal diode.

The invention may advantageously be used for constructing static converters, either for voltage step-up or for step-down. Moreover, the invention may also be used to power TIG, MIG, ARC, and/or spot welding machines, as well as for plasma machines for zinc plating, plasma cutting, etc.

BRIEF DESCRIPTION OF THE DRAWINGS

The characteristics and advantages of the invention will become more apparent from the following description, with reference to the attached drawings, in which.

DETAILED DESCRIPTION OF THE PREFERRED EMBODIMENTS

The invention relates generally to two types of electrical devices, namely impedance step-down and impedance step-up converters. For the former, the output voltage is less than the voltage that continuously powers the diode bridge, while in the latter case it is higher.

Figure 1:
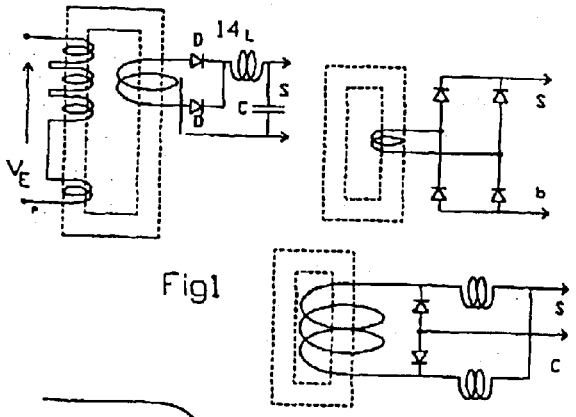
FIG. 1 is a schematic circuit diagram illustrating alternate embodiments of a rectification circuit for a transformer in accordance with the present invention.

Generally speaking, a converter is implemented using several elementary cells, such as those illustrated in FIG. 1. The cell-output connection can be made in series in the case of impedance step-up (FIG. 6*a*), or in parallel for impedance step-down (FIG. 6*b*), or according to various other combinations to best adapt the impedances.

By stacking these elementary circuits and sectioning the primary winding, it becomes possible to stack around the core (1) wafers of primary and secondary circuits using an alternating pattern (e.g., a primary, a secondary, a primary, etc.). This arrangement is of great importance for a transformer because it makes it possible to reduce the leakage inductance. This limits the performance of the converters.

This stack is also significant from the thermal standpoint because it makes it possible to evacuate heat from the windings of the transformer by using conductive plates which are themselves air cooled, cooled by circulating water inside the plates, or by using a thermal diode-based process, for example. The conductive plates 3, from both electrical and thermal standpoints, can advantageously be made of copper or aluminum and thereby be used as the primary as well as the secondary winding, or both simultaneously. Another advantageous aspect of the stack is that, from an economic and industrial standpoint, it may be used with a wide variety of converters and other standard power components which are connected in large numbers in serial-parallel combinations, for both the primary as well as the secondary windings.

Silicon diodes 4 are advantageously formed as thin chips (e.g., by molybdenum infusion) directly in contact with the conductive plates 3 or collecting plates 14. The arrangement of the silicon diodes 4 makes it possible to eliminate the connection wires and thereby reduce the link inductance between the transformer and the rectifiers. The link inductance may be further decreased in certain cases by placing in parallel a large number of elementary circuits.

As such, the invention reduces the interference inductance in series with the bridge, which is the sum of the leakage inductance of the transformer and the connection inductance. This makes it possible to operate at a higher frequency than with conventional transformers. The result is a reduction in space requirements, mass, and ultimately the cost of the converters. By way of example, it was possible to make converters operating at 5 kHz and capable of delivering continuous power of 250 kW which fit into a shoe box in accordance with the present invention.

The elementary cell of the converter shown in FIG. 1 includes a ferromagnetic core 1 made of thin-laminated (0.05 to 0.1 mm) silicon iron or ferrite or of amorphous material. Around the core 1 are arranged a primary winding P and a secondary winding S. The primary winding may, depending on the case, include a metal plate 3, advantageously of copper or aluminum, cooled by air or by water, or a winding of double-spiral enameled wire 2.

The secondary winding S has a midpoint that can be made by assembling two plates 3 that are interconnected by a conductive column 12 when the primary winding is a double-spiral winding 2, or two spiral windings when the primary includes a plate 3. It is to be noted that, in this latter case, a double-spiral winding 2 may also be used provided that a rectification is used in accordance with the circuits illustrated at b or c in FIG. 1. In some cases, the secondary circuit may simply be a turn made of a plate 3 with rectification according to the circuit illustrated at c in FIG. 1.

Figure 6:
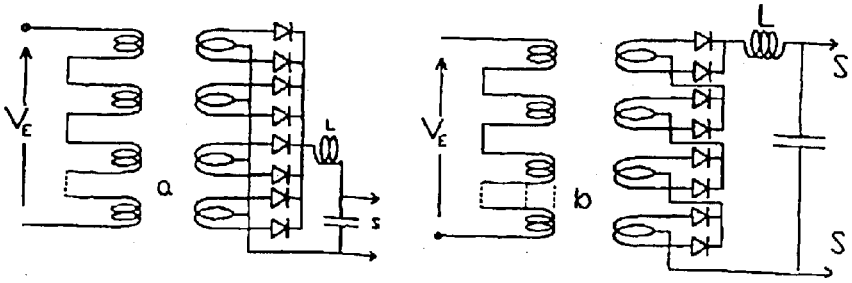
FIG. 6 is a schematic circuit diagram illustrating embodiments for connecting the rectification cells of FIG. 3 in parallel and in series.

The elementary cell illustrated in FIG. 1 has a rectification circuit which uses two diodes D. It may have a filtering capacitor C, but this can also be placed at the outlet of the converter, i.e., after all the elementary cells have been connected in parallel as illustrated in FIG. 6*a*, or in series as illustrated in FIG. 6*b*.

Figure 2:
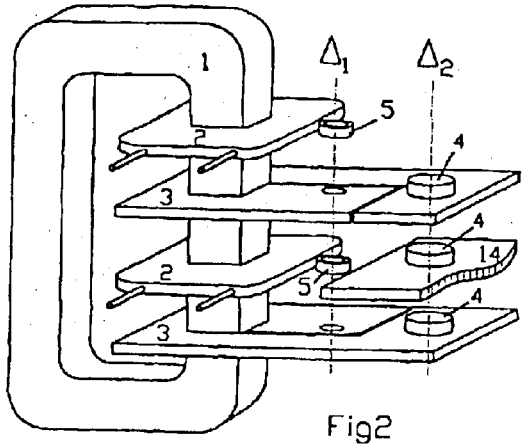
FIG. 2 is a perspective view of a converter including an impedance step-down transformer and associated rectifier in accordance with the present invention.

According to one embodiment of the invention given by way of non-limiting example, the static converter is used to obtain high currents at low voltages. Let us take as an example the case of a power supply for spot welding capable of delivering 10,000 A at a voltage of 10 V. To achieve this intensity, according to the diagram in FIG. 6*b*, several (e.g., five) cells as illustratively shown in FIG. 2 (i.e. each having two copper secondary plates 3 surrounding a primary winding 2) may be connected in parallel.

Figure 3:
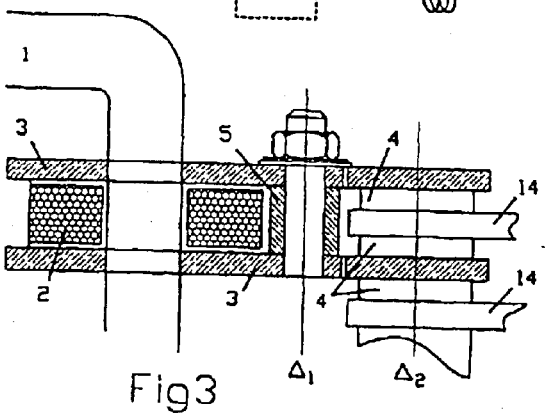
FIG. 3 is a partial cross-sectional view of the converter of FIG. 2 illustrating the midpoint connection of the secondary winding for the rectifier illustrated at a in FIG. 1.
Figure 4:
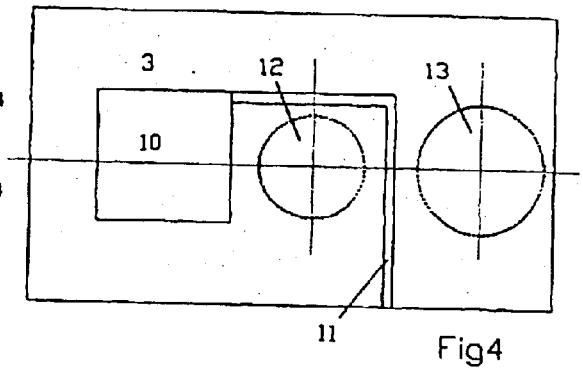
FIG. 4 is a top plan view of one of the plates which forms the secondary winding of the converter illustrated in FIG. 3.
Figure 5:
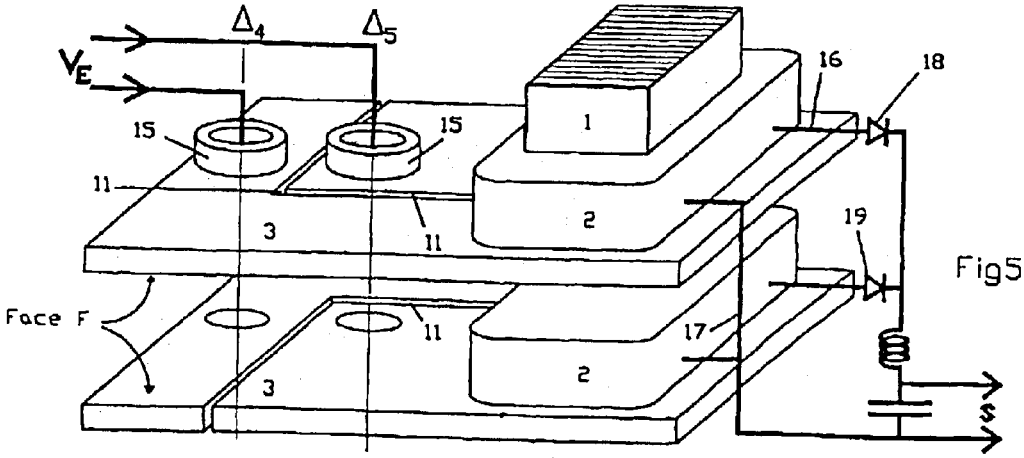
FIG. 5 is a more detailed partial perspective view of the converter of FIG. 3 illustrating an impedance step-up converter therefor.

The cross-section shown in FIG. 3 allows one to better understand how the circuit is made. The two plates 3 are shown in FIG. 4. They have an aperture 10 into which the core 1 passes, as well as a slit 11 for forming a turn. The diodes can be placed either in the position 12, in which case the midpoint is at 13, or in the position 13 (midpoint at 13) according to the diagram in FIG. 2. Between these two plates is placed a flat winding made either by winding two superimposed spirals of enameled wire interconnected at the center, or by stacking plates having a turn interconnected by conductive columns in quincunx fashion as illustrated in FIG. 5. This type of winding has the advantage of a small thickness, which provides good heat dissipation and also provides outlets on the outside without requiring excess thickness.

The connection of midpoints of the primary windings that form one of the rectification outlets is made by tightening along an axis $\Delta_1$ a copper spacer 5 with a steel rod passing through the hole 12 in the plate 13. The rectification diodes are made by direct placement of the silicon chips 4 (often called fusion) between the plates 3 and 14 along an axis $\Delta_2$. Thus, the diodes connect the ends 13 of the turns cut out between the plates 3 by the slit 11 in the collection segments 14 that form the other outlet of the collector. For the copper plate-diode contacts to have little resistance, it may be desirable to securely tighten the stack along axis $\Delta_2$ using screws or threaded steel rods.

The primary windings, all of which are connected in series as illustrated in FIG. 6*b*, will be powered by a symmetrical bridge. It may operate, for example, at a frequency in a range of about 3 to 10 kHz, for example. If, for example, it is at 5 kHz and a core with a useful cross-section of 5 $cm^2$ is used, working at a peak induction of 1 T, the primary winding will require 55 turns. This will be done, for example, by using five windings 2 each eleven turns each. As such, the transformation ratio will be 55. The cooling of the diodes and the transformer may be achieved using plates 3 and collectors 14, which are cooled by water or by air.

According to another embodiment of the invention, also given by way of non-limiting example, the converter of the invention is used as a high-voltage source, which may be referred to as an impedance step-up converter. In this case, the plates 3 are used to make the primary windings as shown in FIG. 5.

By way of example, let us consider the specific case of a high voltage power supply delivering a voltage of 5600 volts. Let us assume that the core has a cross-section of 50 $cm^2$ and that it withstands a peak induction of 0.28 T at the frequency of 5 kHz. The number of primary turns, i.e., of plates 3 that are connected in series by the set of connection columns $\Delta_1$ and $\Delta_2$, will be twenty. The connections of plates will be done by a series of spacers 15 that are alternately insulating or conductive. As before, the plates 3, which have an aperture 10 to let the core pass and a slit 11 necessary for forming a turn, are stacked alternately with face side F up, then down, then up, etc., so that the turns turn in the same direction and form a spiral winding.

The secondary windings are formed by double-spiral type windings 2, which have been described above. A cell using two windings 2 that are connected in a suitable direction so that the two outlet wires 16 and 17 deliver plain pulses in phase opposition is illustrated in FIG. 5. Under these conditions, the diodes 18 and 19 allow a so-called two-phase rectification.

Connection of the elementary cells may be achieved as illustratively shown in FIG. 6*b*. With ten plates 3 in the primary winding, it will be possible to make five cells. Each winding preferably has twenty turns. As similarly described above, the cooling of the transformer can advantageously be accomplished using plates 3 which are air cooled or water cooled. FIG. 6*b* illustrates a filtering cell placed on the outlet of the converter.

According to yet another embodiment of the invention, again given by way of non-limiting example, the transformer includes between its conductive plates 20 (which have a slightly different shape and are used this time as the primary winding) a series of generators including bridges. This is done to reduce the connection inductance between the generator and the transformer. In fact, this inductance is added to the two inductances (i.e., leakage inductance and inductance of connections of the rectifiers) mentioned above.

Figure 7:
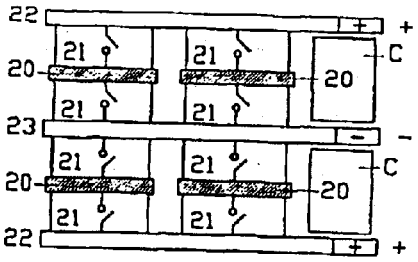
FIG. 7 is a side view of the transformer of FIG. 3 including a bridge switching generator integrated into the structure of the transformer.
Figure 8:
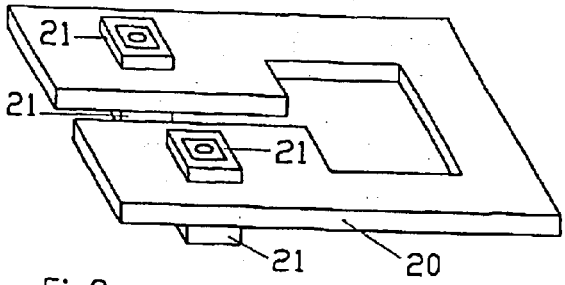
FIG. 8 is a perspective view of the primary winding associated with the generator of FIG. 7 including transistors which form the branches of the bridge.
Figure 9:
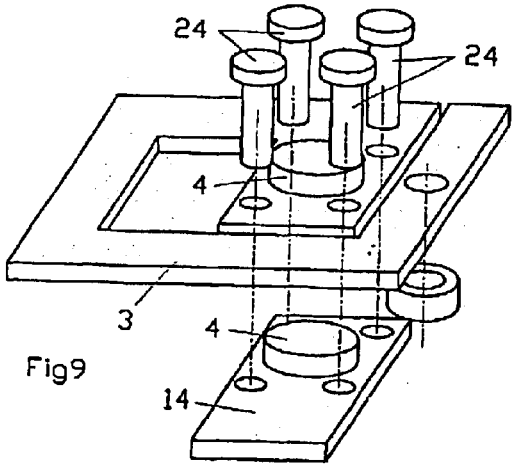
FIG. 9 is a perspective view illustrating assembly of the stack of diodes of the converter of FIG. 3.

This generator is illustrated in FIG. 7 and, as above, includes several cells for making the primary-secondary alternation. The figure shows two points that use the relatively flat transistors 21, which may be MOS or IGBT, for example. They are connected according to the classical bridge configuration, between continuous power supply plates 22, 23 with +polarity and with −polarity, respectively. Capacitors C are also arranged as close as possible to the transistors 21, between the plates 22 and 23.

The secondary winding is made as above with integrated rectifiers, provided that it is sectioned. The sectioning can be obtained even in the case of a single winding. It is sufficient in this case to connect, in series, flat windings 2 or plates to a turn 3 that is connected in series by conductive columns 15.

Figure 11:
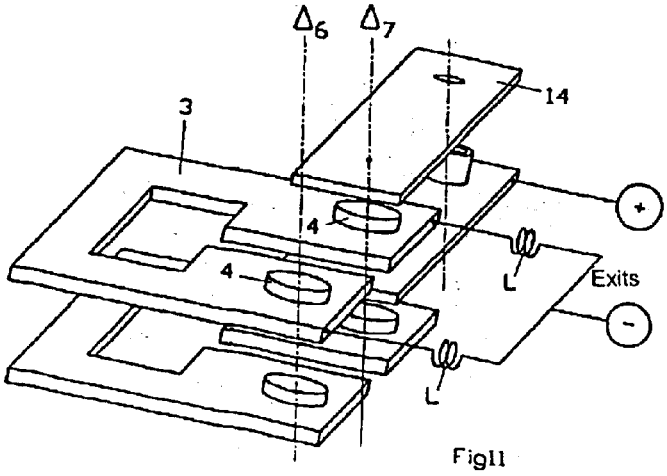
FIG. 11 is a perspective view of an alternate embodiment of the invention using the rectification circuit illustrated at c in FIG. 1.
Figure 12:
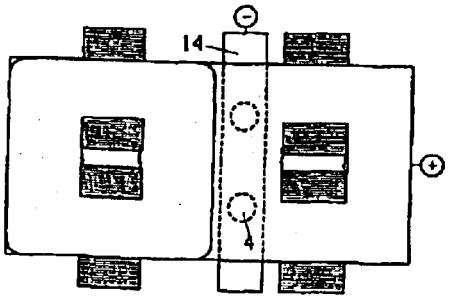
FIG. 12 is a top plan view of the embodiment illustrate in FIG. 11 with portions shown in section.

According to a fourth embodiment of the invention, once again given by way of non-limiting example, a rectification is done according to the circuit illustrated at c in FIG. 1. In this case, the diodes 4 are stacked between the secondary windings 3 and the collecting plates 14 along axes $\Delta_6$ and $\Delta_7$ (see FIG. 11). The plate 3 can be extended to make L inductances by placing two cores 25 between the rectifier and the outlet as shown in FIG. 12.

One important consideration in making the invention is the tightening of the diodes. A contact under constant pressure is desirable, regardless of the differential dilations. To maintain contact over the entire surface of the diode, it is desirable to have substantially uniform flatness of the conductive segments 3 and 14. The tightening is performed using several screws (e.g., four or more) 24, preferably with a high elastic limit.

Another important consideration is the cooling of the conductive plates 3 and 4, which provides for removal of heat from the windings of the transformer, and, more particularly, from the diodes 4. This may be particularly important in certain applications such as some spot welding machines, for example, in which very high power may be used. The cooling can be done simply by giving the plates 3 and 14 a sufficient surface over which forced air is caused to circulate. For higher powers, it may be necessary to use a liquid heat-exchanging medium (water, glycol, Coolanol, Freon, oil, etc.).

Figure 10:
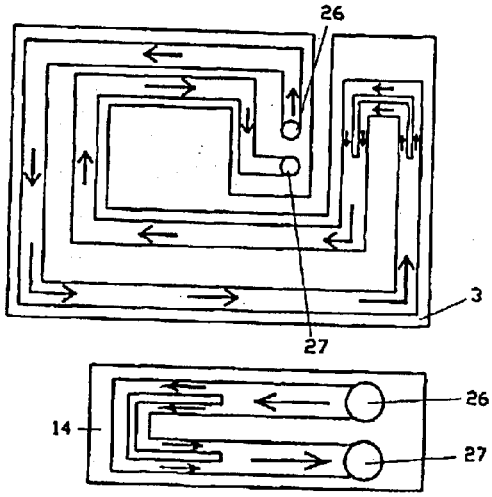
FIG. 10 includes plan views illustrating cooling channels of the conductive plates and the collecting plates of the converter of FIG. 3.

The plates include two copper sheets. Channels are engraved into one of them (see FIG. 10) and the two sheets are brazed together, such that it is possible to cause liquid to circulate in the thickness of the sheet. The liquid is introduced, for example, through the hole 26 and extracted through the hole 27 by an appropriate set of hollow, watertight spacers (not shown). Thus, it is possible to channel the liquid up to the point of the diode.

The invention may also advantageously be used in cases where a static converter is required. By way of example, the present invention may be used in very-low-impedance generators for equipping spot-welding machines, low-impedance generators for powering MIG or TIP type welding torches and cutting torches, high-voltage generators, condenser chargers, battery chargers/dischargers, etc.

That which is claimed is:

1. A transformer comprising:

a magnetic core branch;

at least one winding comprising a plurality of conductive segments surrounding said magnetic core branch;

at least one respective rectification diode positioned between adjacent conductive segments; and a plurality of flat windings on said magnetic core branch stacked in alternating fashion with said conductive segments.

2. The transformer of claim 1 wherein the transformer has an operating frequency in a range of about 3 to 50 kHz.

3. The transformer of claim 1 wherein said rectification diodes are implemented in integrated circuit chips.

4. The transformer of claim 1 wherein said rectification diodes comprise at least one of silicon, copper and aluminum.

5. The transformer of claim 1 wherein said at least one winding comprises a primary winding, and further comprising a secondary winding and a pair of diodes connected in parallel between said primary and secondary windings.

6. The transformer of claim 1 further comprising a diode bridge connected to said at least one winding.

7. The transformer of claim 1 further comprising at least one inductor connected to said at least one winding.

8. The transformer of claim 1 further comprising compression means for compressing said rectification diodes between respective conductive segments.

9. The transformer of claim 1 wherein said conductive segments have at least one thermal fluid channel defined therein.

10. The transformer of claim 1 further comprising a respective conductive column connecting adjacent conductive segments in series.

11. The transformer of claim 10 wherein said conductive columns are arranged in quincunx fashion.

12. The transformer of claim 1 further comprising a plurality of U-shaped conductive plates and a plurality of switches selectively connecting said U-shaped plates together to provide a primary winding; wherein said at least one winding comprises a secondary winding; and wherein said U-shaped conductive segments are stacked in alternating fashion with said conductive segments.

13. The transformer of claim 1 wherein said at least one winding has first and second ends, and further comprising:

a respective diode connected to the first and second ends of said at least one winding and connected together at a midpoint; and a respective conductor connecting adjacent midpoints of said diodes together along a first axis;

said rectification diodes being positioned along a second axis.

14. The transformer of claim 1 wherein said flat windings comprise enamel wire windings and define two superimposed spirals connected at a center thereof, one of the spirals being centripetal and the other centrifugal.

15. The transformer of claim 1 wherein said plurality of flat windings define a spiral and are welded together.

16. The transformer of claim 1 wherein said conductive segments comprise flat thermal diodes.

17. A transformer comprising:

a magnetic core branch;

at least one winding comprising a plurality of conductive segments surrounding said magnetic core branch;

at least one respective integrated rectification diode positioned between adjacent conductive segments;

a plurality of flat windings on said magnetic core branch stacked in alternating fashion with said conductive segments; and a compression device for compressing said integrated rectification diodes between respective conductive segments.

18. The transformer of claim 17 wherein said at least one winding comprises a primary winding, and further comprising a secondary winding and a pair of diodes connected in parallel between said primary and secondary windings.

19. The transformer of claim 17 further comprising a diode bridge connected to said at least one winding.

20. The transformer of claim 17 further comprising at least one inductor connected to said at least one winding.

21. The transformer of claim 17 wherein said conductive segments have at least one thermal fluid channel defined therein.

22. The transformer of claim 17 further comprising a respective conductive column connecting adjacent conductive segments in series.

23. The transformer of claim 17 further comprising a plurality of U-shaped conductive segments and a plurality of switches selectively connecting said U-shaped plates together to provide a primary winding; wherein said at least one winding comprises a secondary winding; and wherein said U-shaped conductive segments are stacked in alternating fashion with the conductive segments.

24. The transformer of claim 17 wherein said at least one winding has first and second ends, and further comprising:

a respective diode connected to the first and second ends of said at least one winding and connected together at a midpoint; and a respective conductor connecting adjacent midpoints of said diodes together along a first axis;

said integrated rectification diodes being positioned along a second axis.

25. The transformer of claim 17 wherein said flat windings comprise enamel wire winding and define two superimposed spirals connected at a center thereof, one of the spirals being centripetal and the other centrifugal.

26. The transformer of claim 17 wherein said plurality of flat windings define a spiral and are welded together.

27. The transformer of claim 17 wherein said conductive segments comprise flat thermal diodes.

28. A static converter comprising:

at least one input terminal and at least one output terminal; and a transformer connected between said at least one input terminal and said at least one output terminal and comprising a magnetic core branch, at least one winding comprising a plurality of conductive segments surrounding said magnetic core branch, at least one respective rectification diode positioned between adjacent conductive segments, and a plurality of flat windings on said magnetic core branch stacked in alternating fashion with said conductive segments.

29. The static converter of claim 28 wherein said rectification diodes are implemented in integrated circuit chips.

30. The static converter of claim 28 wherein said at least one winding comprises a primary winding, and wherein said transformer further comprises a secondary winding and a pair of diodes connected in parallel between said primary and secondary windings.

31. The static converter of claim 28 wherein said transformer further comprises a diode bridge connected to said at least one winding.

32. The static converter of claim 28 wherein said transformer further comprises at least one inductor connected to said at least one winding.

33. The static converter of claim 28 wherein said transformer further comprises a compression device for compressing said rectification diodes between respective conductive segments.

34. The static converter of claim 28 wherein said conductive segments have at least one thermal fluid channel defined therein.

35. The static converter of claim 28 wherein said transformer further comprises a plurality of U-shaped conductive segments and a plurality of switches selectively connecting said U-shaped plates together to provide a primary winding; wherein said at least one winding comprises a secondary winding; and wherein said U-shaped conductive segments are stacked in alternating fashion with said conductive segments.

36. The static converter of claim 28 wherein said transformer provides step-up conversion.

37. The static converter of claim 28 wherein said transformer provides step-down conversion.

38. A method for making a transformer comprising:

positioning at least one winding comprising a plurality of conductive segments so that conductive segments surround a magnetic core branch;

positioning at least one respective rectification diode between adjacent conductive segments; and stacking a plurality of flat windings on the magnetic core branch in alternating fashion with the conductive segments.

39. The method of claim 38 wherein the rectification diodes are implemented in integrated circuit chips.

40. The method of claim 38 wherein the at least one winding comprises a primary winding; and further comprising connecting a pair of diodes in parallel between the primary winding and a secondary winding.

41. The method of claim 38 further comprising connecting a diode bridge to the at least one winding.

42. The method of claim 38 further comprising connecting at least one inductor to the at least one winding.

43. The method of claim 38 further comprising compressing the rectification diodes between respective conductive segments using a compression device.

44. The method of claim 38 further comprising defining at least one thermal fluid channel in the conductive segments.

45. The method of claim 38 further comprising connecting the conductive segments in series using conductive columns.

* * * * *